United States Patent [19]

Alanko et al.

[11] Patent Number: 4,659,374

[45] Date of Patent: Apr. 21, 1987

[54] MIXED BINDER SYSTEMS FOR AGGLOMERATES

[75] Inventors: Allan M. Alanko, Freeland; William H. Atwell, Midland, both of Mich.

[73] Assignee: Dow Corning Corporation, Midland, Mich.

[21] Appl. No.: 744,605

[22] Filed: Jun. 14, 1985

[51] Int. Cl.[4] ..... C22B 1/244

[52] U.S. Cl. ..... 75/3; 75/10.61; 420/478; 423/350

[58] Field of Search ..... 75/3, 10.61; 423/350; 420/478

[56] References Cited

U.S. PATENT DOCUMENTS

| | | | |
|---|---|---|---|
| 2,808,325 | 10/1957 | Subervie et al. | 75/3 |
| 3,218,153 | 11/1965 | Schei et al. . | |
| 3,307,927 | 3/1967 | Muschenborn et al. | 75/3 |
| 3,892,558 | 7/1975 | Ilinkov et al. . | |
| 4,046,558 | 9/1977 | Das et al. . | |
| 4,155,753 | 5/1979 | Ryabchikov et al. . | |
| 4,168,966 | 9/1979 | Furvi et al. . | |
| 4,309,216 | 1/1982 | Merhert . | |
| 4,348,230 | 9/1982 | Aitein et al. . | |
| 4,366,137 | 12/1982 | Lask . | |
| 4,369,062 | 1/1983 | Strange | 75/3 |
| 4,389,493 | 6/1983 | Lask . | |
| 4,394,167 | 7/1983 | Kuwahara . | |
| 4,395,285 | 7/1983 | Merhert . | |
| 4,501,593 | 2/1985 | Paersch et al. | 75/3 |

FOREIGN PATENT DOCUMENTS

| | | | |
|---|---|---|---|
| . 205850 | 12/1967 | U.S.S.R. | 420/578 |

*Primary Examiner*—Melvyn J. Andrews
*Attorney, Agent, or Firm*—Robert L. McKellar

[57] ABSTRACT

A novel mixed binder system for agglomerates is disclosed. The agglomerates are suitable for use in the production of metals and alloys in a carbothermic reduction process such as the production of silicon in a direct arc furnace by the carbothermic reduction of silica. The agglomerates prepared using this mixed binder system have high physical strength over a wide temperature range. The mixed binder system consists essentially of a primary binder selected from the group consisting of coal tar pitch, asphalt, and petroleum pitch and a secondary binder selected from the group consisting of lignosulfonate salts, carbohydrates, and silicates.

17 Claims, No Drawings

MIXED BINDER SYSTEMS FOR AGGLOMERATES

BACKGROUND OF INVENTION

This invention relates to a novel binder system for agglomerates. This invention also relates to a novel binder system for agglomerates suitable for use in a direct arc furnace for production of silicon or ferrosilicon metal. The binder system of this invention produces agglomerates which can withstand the environment of a direct arc furnace better than prior art agglomerates.

Agglomerates have been used in the production of metals and metal alloys, including silicon and silicon-containing alloys, by the carbothermic reduction of the corresponding metal oxides. For example, Schei et al. in U.S. Pat. No. 3,218,153 (issued Nov. 16, 1965) prepare silicon and other metals from pellets or briquetts consisting of a core which contains an excess of the metal oxide surrounded by a second layer or shell which contains an excess of the carbonaceous reducing agent. Schei et al. employed conventional binders such as Portland or alumina cement, molasses, bentonite or sulphite lye to prepare the agglomerates.

Ilinkov et al. in U.S. Pat. No. 3,892,558 (issued Jul. 1, 1975) prepared aluminum-silicon alloys using briquettes in an electric arc furnace. The briquettes were prepared using an alcohol-sulphite lye binder.

Das et al. in U.S. Pat. No. 4,046,558 (issued Sept. 6, 1977) prepared aluminum-silicon alloys from briquettes containing metal oxides and a carbonaceous reducing agent in a blast or electric arc furnace. The briquettes did not contain any additional binder.

Ryabchikov et al. in U.S. Pat. No. 4,155,753 (issued May 22, 1979) disclosed a continuous one step process for the production of silicon-containing ferro alloys employing briquettes in a smelting furnace. The briquettes did not contain any additional binder.

Furui et al. in U.S. Pat. No. 4,168,966 (issued Sept. 25, 1979) employed pellets and briquettes containing iron ores in a blast furnace. The pellets or briquettes contained iron ore, additives, and a hydraulic binder. Hydraulic binders included portland cement, portland cement clinker, alumina cement, alumina cement clinker, cement mixed with blast furnace slag, cement mixed with fly ash, cement mixed with borazon and masonry-mixed cement.

Merkert in U.S. Pat. Nos. 4,309,216 (issued Jan. 5, 1982) and 4,395,285 (issued Jul. 26, 1983) prepared low density, porous compacts containing silica fume, finely-divided carbonaceous reducing agents such as petroleum coke or coal and, optionally, iron and a binder, in preparing silicon and ferrosilicon. The binder was a cereal binder such as corn starch.

Lask in U.S. Pat. Nos. 4,366,137 (issued Dec. 28, 1982) and 4,389,493 (issued June 21, 1983) prepared silicon in an electric furnace using briquettes containing quartz and a caking coal. The briquettes were prepared by hot briquetting the formed body at 350°-550° C. No additional binders were used.

Kuwahara in U.S. Pat. No. 4,394,167 (issued Jul. 19, 1983) disclosed a process of carbothermically producing aluminum using briquettes prepared from alumina, silica, and iron oxide bearing materials and coking coal. The briquettes were formed by heating the formed mixture to 600°-900° C. The direct coking operation is said to eliminate the volatile matter in the coal and produce an alumina bearing coked briquette which has a porous coked structure. No additions binders are employed in the process of Kuwahara.

Sodium and calcium lignosulfonates have been used as binders for preparing briquettes of silicon and ferrosilicon dust by Aitcin et al. in U.S. Pat. No. 4,348,230 (issued Sept. 7, 1982). Such briquettes do not contain either metal oxides or reducing agents.

The agglomerates found in the prior art generally lack the physical strength to function well in the demanding environment of a blast, smelting, or electric arc furnace over the entire temperature range found in such environments. The prior art agglomerates generally lack sufficient strength at either low or high temperatures. The prior art agglomerates which possess sufficient strength at high temperatures generally do not possess sufficient strength at low temperatures. And the prior art agglomerates which possess sufficient strength at low temperatures generally do not possess sufficient strength at high temperatures. Agglomerates which have sufficient strength at both low and high temperatures would be very desirable.

It is an object of this invention to provide agglomerates which have sufficient strength at both low and high temperatures. It is another object of this invention to provide agglomerates which have adequate strength to survive the environment of a blast, smelting or electric arc furnace over a wide temperature range. It is still another object of this invention to provide agglomerates containing metal oxide-containing materials, carbonaeous reducing agents, and a mixed binder system. It is still another object of this invention to provide a method of preparing metals and metal alloys, especially silicon and silicon-containing alloys, using agglomerates prepared using a mixed binder system. Other objects will be apparent upon a consideration of this specification.

THE INVENTION

This invention relates to a method of making agglomerates for use in the production of metals and metal alloys, said method comprising the steps of (A) wet mixing (1) a material or materials capable of being reduced, (2) a carbonaceous reducing agent, and (3) a mixed binder system;

(B) forming the wet mixture of step (A) into agglomerates using pressure, and (C) drying the agglomerates formed in step (B);

wherein said mixed binder system consists essentially of a primary binder and a secondary binder; wherein said primary binder is selected from the group consisting of coal tar pitch, asphalt, and petroleum pitch; wherein said secondary binder is selected from the group consisting of lignosulfonate salts, carbohydrates, and silicates; and wherein the weight ratio of the primary binder to the secondary binder varies from about 20:1 to 1:20 in said mixed binder system.

This invention relates to a method of making agglomerates for use in the production of silicon, said method comprising the steps of (A) wet mixing a silica-containing material, a carbonaceous reducing agent, and a mixed binder system, (B) forming the wet mixture of step (A) into agglomerates using pressure, and (C) drying the agglomerates formed in step (B);

wherein said mixed binder system consists essentially of a primary binder and a secondary binder; wherein said primary binder is selected from the group consisting of coal tar pitch, asphalt, and petroleum pitch; wherein said secondary binder is selected from the group consisting of lignosulfonate salts, carbohydrates, and silicates; and wherein the weight ratio of the primary binder to the secondary binder varies from about 20:1 to 1:20 in said mixed binder system.

This invention also relates to agglomerates consisting essentially of (1) a material or materials capable of being reduced, (2) a carbonaceous reducing agent, (3) a primary binder and (4) a secondary binder; wherein said primary binder is selected from the group consisting of coal tar pitch, asphalt, and petroleum pitch; wherein said secondary binder is selected from the group consisting of lignosulfonate salts, carbohydrates, and silicates; and wherein the weight ratio of the primary binder to the secondary binder varies from about 20:1 to 1:20.

This invention also relates to agglomerates consisting essentially of a silica-containing material, a carbonaceous reducing agent, a primary binder and a secondary binder; wherein said primary binder is selected from the group consisting of coal tar pitch, asphalt, and petroleum pitch; wherein said secondary binder is selected from the group consisting of lignosulfonate salts, carbohydrates, and silicates; and wherein the weight ratio of the primary binder to the secondary binder varies from about 20:1 to 1:20.

This invention also relates to agglomerates consisting essentially of (1) 0–98 weight percent of a material or materials capable of being reduced which are selected from the group consisting of a silica-containing material, an iron oxide-containing material, a nickel oxide-containing material, a chromium oxide-containing material, a fluorite-containing material, and an alumina-containing material, (2) 0–98 weight percent of a carbonaceous reducing agent, and (3) 2–35 weight percent of a mixed binder system; wherein the combined percentages of said material or materials capable of being reduced and said carbonaceous reducing agent is 65–98 weight percent; wherein said mixed binder system consists essentially of a primary binder and a secondary binder; wherein said primary binder is selected from the group consisting of coal tar pitch, asphalt, and petroleum pitch; wherein said secondary binder is selected from the group consisting of lignosulfonate salts, carbohydrates, and silicates; and wherein the weight ratio of the primary binder to the secondary binder varies from about 20:1 to 1:20.

This invention further relates to a method for the production of metals or metal alloys, said method comprising (A) treating a mixture containing (1) a material or materials capable of being reduced which are selected from the group consisting of of a silica-containing material, an iron oxide-containing material, a nickel oxide-containing material, a chromium oxide-containing material, a fluorite-containing material, and an alumina-containing material, and (2) a carbonaceous reducing agent, said mixture being treated in a furnace at a temperature sufficient to reduce said material or materials to the metals or metal alloys and (B) collecting the metals or metal alloys ;

wherein at least part of said material or materials capable of being reduced and said carbonaceous reducing agent is in the form of agglomerates consisting essentially of (i) said material or materials capable of being reduced, (ii) said carbonaceous reducing agent, (iii) a primary binder and (iv) a secondary binder; wherein said primary binder is selected from the group consisting of coal tar pitch, asphalt, and petroleum pitch; wherein said secondary binder is selected from the group consisting of lignosulfonate salts, carbohydrates, and silicates; and wherein the weight ratio of the primary binder to the secondary binder varies from about 20:1 to 1:20.

The agglomerates of this invention contain a material or materials capable of being reduced and/or a carbonaceous reducing agent and a mixed binder system. The mixed binder system contains a primary binder and a secondary binder. The primary binder is selected from the group consisting of coal tar pitch, asphalt, and petroleum pitch. The coal tar pitch, asphalt, or petroleum pitch can be in various forms including powder, lump, melt, or aqueous emulsion. The preferred primary binder is coal tar pitch. The secondary binder is selected from the group consisting of lignosulfonate salts, carbohydrates, and silicates. Lignosulfonate salts include calcium lignosulfonate, sodium lignosulfonate and ammonia lignosulfonate as well as other metallic and nonmetallic lignosulfonates. Suitable carbohydrates include sugars, starches, dextrans, glycogens, celluloses, alkylated celluloses, and pentosans. The preferred carbohydrates for use in this invention are the starches. Suitable silicates include nesosilicates, sorosilicates, cyclosilicates, inosilicates, phyllosilicates, orthosilicates, bentonites, clays, montmorillonites, cements, and the like.

The preferred mixed binder system contains coal tar pitch as the primary binder and one or more lignosulfonate salts as the secondary binder. The most preferred mixed binder system contains coal tar pitch as the primary binder and calcium lignosulfonate as the secondary binder.

The weight ratio of primary binder to secondary binder in the agglomerates of this invention can range from about 20:1 to 1:20. Preferably the weight ratio of primary binder to secondary binder is in the range of 5:1 to 1:5. Most preferably the weight ratio of primary binder to secondary binder is in the range of about 2:1 to 1:2.

The agglomerates of this invention normally contain about 2 to 35 weight percent of the mixed binder system based on the total, dried weight of the agglomerate. Preferably the agglomerates contains about 6 to 12 weight percent of the mixed binder system based on the total, dried weight of the agglomerate.

The agglomerates of this invention contain, in addition to the mixed binder system, a material or materials capable of being reduced and/or a carbonaceous reducing agent. The material or materials capable of being reduced are referred to as reductants. Suitable reductants include silica-containing materials, iron oxide-containing materials, nickel oxide-containing materials, chromium oxide-containing materials, fluorite-containing materials, and alumina-containing materials. Iron oxide-containing materials include iron ores, cast iron and the like. Nickel oxide-containing materials include nickel ores and the like. Chromium oxide-containing materials include chromite ores and the like. Preferred reductants include silica-containing materials alone and silica-containing materials combined with iron oxide-containing materials. Silica-containing materials include silica, fumed silica, sand, and the like. Sand is one especially preferred silica-containing material. Suitable carbonaceous reducing agents include coals, cokes, lignites, charcoals, lamp black, silicon carbide, vegetable matter such as straw, sawdust, wood chips, and rice hulls, and the like. Preferred reducing agents include coals, cokes, and charcoals. More than one reductant and/or reducing agent may be present in the agglomerates of this invention.

The reducants and reducing agents are normally present in the agglomerates of this invention at total, combined levels of 65 to 98 weight percent and preferably at 88 to 94 weight percent based on the total, dried weight of the agglomerate. The ratio of reductants to reducing agents in the agglomerates of this invention can vary widely. Agglomerates containing either reductants and the mixed binder system only or reducing agents and the mixed binder system only are considered within the scope of this invention. It is preferred, however, that the agglomerates of this invention contain both the reductant and the reducing agent in addition to the mixed binder system. It is preferred that the agglomerates of this invention contain the reductant and reducing agents in a weight ratio of about 2:1 to 1:2. It is preferred that there be at least a sufficient amount of reducing agent required to reduce all of the reductants present in the agglomerate.

The ratios of reductants to reducing agents to primary binder to secondary binder can all vary from one individual agglomerate to another so long as the averages remain within the required ranges.

The agglomerates of this invention can be formed using conventional processing techniques. It is often helpful in preparing the agglomerates of this invention to add water to the mixture of reductants, reducing agents, and mixed binder system before the agglomerates are actually formed. The water acts as a processing aid. Water may be added at levels up to about 20 weight percent based on the total weight of the agglomerate. After the agglomerate is formed, the processing water may be removed by drying. Drying temperatures of about room temperature to 100° C. are preferred although higher temperatures may be used. It is not necessary to remove all of the processing water in a separate drying step since the remainder of the processing water will be removed in the furnace where the actual carbothermic reduction takes place. Any removal of water in the carbothermic reduction furnace is, for the purposes of this invention, considered part of the drying step.

The agglomerates of this invention are prepared by mixing the various components together and then forming the agglomeratures using pressure. The amount of pressure needed will vary depending upon the actual components employed and other experimental conditions. Typical operating pressures might be in the range of 1500–3000 pounds, although higher or lower pressures may be used. Determination of the pressure needed to form a given agglomerate is best left to simple experimentation. The agglomerates of this invention may be in the form of pellets, briquettes, compression moldings, extrusions and the like.

The agglomerates of this invention are intended to be used to prepare metals or metal alloys in a carbothermic reduction process. Such a process is carried out in a blast, smelting, or electric arc furnace. Suitable furnaces and the procedures of operating such furnaces are well known in the art. The actual metals or metal alloys produced will naturally depend upon the reductants present in the agglomerates. Preferred reductants are silica-containing materials alone and silica-containing materials combined with iron oxide-containing materials. Therefore the preferred metal produced by the process of this invention is silicon and the preferred metal alloy is a silicon-iron alloy. Other metals and metal alloys may be produced by the carbothermic reduction process of this invention. Binary, tertiary, and higher order metal alloys can be produced in this process.

So that those skilled in the art can better appreciate and understand the invention, the following examples are given. Unless otherwise indicated, all percentages are by weight.

The following procedures were used in the examples:

The agglomerates were prepared using the following procedure. The raw materials were mixed in the presence of water in a Simpson Mix-Muller obtained from National Engineering Co. of Chicago, Ill. The mixed raw materials were then formed into agglomerates in a Model B-100 two roll hydraulic press from K. R. Komerak, Inc. of Elk Grove Village, Ill., at a pressure of 2000–2700 psig. The pocketed rollers produced oval, pillow-shaped agglomerates or briquettes with nominal dimensions of $1\frac{5}{8}$ by $\frac{7}{8}$ by $\frac{5}{8}$ inches. The green briquettes were then cured or dried at room temperature (about 25° C.) for 24 hours. The cured or dried briquettes were fired at 950° C. for seven minutes in a covered crucible.

The drop strength or drop loss of the various briquettes was determined by dropping the briquettes from a height of six feet. About ten briquettes are allowed to free fall onto a steel plate. All the material, both broken and unbroken, was collected and the drop repeated for a total of three drops. The percentage of dropped material which passed through a 3 mesh screen is reported as the drop loss. This test is similar to ASTM procedures D-440 and D-3038.

Crush strengths were measured using a hardness tester form Nels Jorgenson and Co., St. Clair Shores, Mich. An individual briquette was placed between two flat steel plates of the tester. The pressure on the briquette was slowly increased until the briquette fractured at which point the applied pressure was recorded. The reported crush strength was obtained by averaging the results over ten randomly selected briquettes. This test procedure is similar to ASTM D-3313. The tester limit was 190 pounds. Briquettes with crush strengths greater than this limit are reported as greater than 190 pounds.

The following raw materials were used in the examples.

The sand employed was Oklahoma No. 1 from Pennsylvania Glass Sand Corp. of Berkely Springs, W.V. from a quarry located in Mill Creek, Okla. The sand contained about 99.7 percent $SiO_2$ and was 95 percent minus 70 mesh with a mean particle size of 100 mesh (using American Society Testing Materials Mesh - (ASTM).

The petroleum coke was from either Koch Carbon Co. of Roseport, Minn. or Texaco Corp. of Collier, Calif. The Koch petroleum coke had a fixed carbon value of about 89 percent. The Texaco material had a fixed carbon value of about 87 percent. The coal employed was a Kentucky Joyner Blue Gem coal obtained from Hickman, Williams and Co. of Detroit, Mich. The petroleum cokes and the coal were ground at either Particle Control Inc. of Abertville, Minn. or Schulty Oneill Co. of Roseport, Minn. Both ground petroleum cokes and the ground coal had a mean particle size of about 50 mesh (ASTM).

Numerous binder were employed in the examples. Corn starch (Staramic 747) was obtained from A. E. Staley Mfg. Co. of Decatur, Ill. Pulverized coal tar pitch and pulverized petroleum pitch were obtained from Crowley Tar Products Co. of New York, N.Y. Ashpalt emulsion (K-15H emulsion at 60 percent solids) was obtained from Koppers Company, Inc. of Monroeville, Pa. Samples of calcium lignosulfonate (tradename Lignosite used as both a 50% neutralized aqueous solution and as a powder), ammonia lignosulfonate (tradename Lignosite 17 used as both an aqueous solution and as a powder), and sodium lignosulfonate (tradename Lignosite 458 powder) were obtained from Georgia Pacific Corp. of Bellingham, Wash. A 50% ammonia lignosulfonate aqueous solution (tradename Norlig NH) was obtained from American Can Co. of Oakland, Ill. Other binders used were calcium lignosulfonate (tradename Orzan LS), sodium lignosulfonate (tradename Orzan S powder) and ammonium lignosulfonate (tradename Orzan A powder) from ITT Rayonier Chemical Products of Stamford, Conn.

Example 1. Ten different samples of briquettes were prepared using varying amounts of coal tar pitch as the primary binder and calcium lignosulfonate (Lignosite) as the secondary binder in the mixed binder system. The amounts of primary and secondary binders used and the resulting weight ratio of primary binder to secondary binder in the briquettes are given in Table I. The percentages of the binders are based on the dried weight of the briquettes. The briquettes of runs 1–3, 7, 8 and 10 were prepared from mixtures containing 5000 parts by weight sand, 2500 parts by weight petroleum coke, 2500 parts by weight coal, 150–200 parts by weight water, and the appropriate amounts of binders. The briquettes of runs 4 and 9 were prepared from mixtures containing 6000 parts by weight sand, 3000 parts by weight petroleum coke, 3000 parts by weight coal, 100–150 parts by weight water, and the appropriate amounts of binders. The briquettes of run 5 were prepared from mixtures containing 6000 parts by weight sand, 1666 parts by weight petrolum coke, 1740 parts by weight coal, 200 parts by weight water, and the appropriate amounts of binders. The briquettes of run 6 were prepared from mixtures containing 3000 parts by weight sand, 2500 parts by weight petrolum coke, 2610 parts by weight coal, 175 parts by weight water, and the appropriate amounts of binders. The briquettes in runs 1 and 2 are presented for comparison purposes only.

TABLE I

| Run No. | Primary Binder, % | Secondary Binder, % | Weight Ratio |
|---|---|---|---|
| 1 | 3.8 | 0 | — |
| 2 | 0 | 5.3 | — |
| 3 | 1.8 | 6.4 | 0.29 |
| 4 | 3.8 | 4.6 | 0.80 |
| 5 | 3.7 | 4.6 | 0.80 |
| 6 | 3.7 | 4.6 | 0.80 |
| 7 | 1.9 | 2.4 | 0.80 |
| 8 | 6.8 | 8.5 | 0.80 |
| 9 | 3.8 | 2.3 | 1.60 |
| 10 | 5.5 | 2.8 | 2.00 |

The strengths of the various briquettes prepared in runs 1–10 were determined. The results for green, dried and fired briquettes are presented in Table II.

TABLE II

| | Crush Strength (lbs) | | | Drop Loss (%) | |
|---|---|---|---|---|---|
| Run No. | Green | Dried | Fired | Green | Dried |
| 1 | 28 | 29 | 60 | 55 | 54 |
| 2 | 18 | 69 | 104 | 0.5 | 6.6 |
| 3 | 64 | 130 | 126 | 0.8 | 3.9 |
| 4 | 50 | 164 | 182 | 0.8 | 1.7 |
| 5 | 31 | 63 | 61 | 0.4 | 13 |
| 6 | 70 | 111 | 150 | 0.8 | 5.3 |
| 7 | 27 | 79 | 129 | 21 | 17 |
| 8 | 88 | >190 | — | 0.4 | 2.5 |
| 9 | 25 | 63 | 139 | — | — |
| 10 | 30 | 73 | 128 | 12 | 16 |

It is clear from this example that the mixed binder system of this invention yields agglomerates which generally exhibit high strengths over a wide temperature range. It is also clear that the mixed binder system of this invention yields agglomerates which generally exhibit higher strengths as compared to agglomerates prepared with only the primary binder or only the secondary binder and that these higher values are exhibited over a wide temperature range.

Example 2. This example demonstrates the preparation of briquettes using a corn starch (Staramic 747) as the secondary binder with various primary binders. The identity of the primary binder and the amounts of the binders used are given in Table III. The percentages of the binders is based on the dried weight of the briquettes. The briquettes of runs 11 and 13 were prepared from mixtures containing 5000 parts by weight sand, 2500 parts by weight petrolum coke, 2500 parts by weight coal, 150–250 parts by weight water, and the appropriate amounts of binders. The briquettes of run 12 were prepared from mixtures containing 6000 parts by weight sand, 3071 parts by weight petrolum coke, 3243 parts by weight coal, 320 parts by weight water, and the appropriate amounts of binders. The briquettes of run 14 were prepared from mixtures containing 6000 parts by weight sand, 3125 parts by weight petrolum coke, 3150 parts by weight coal, 320 parts by weight water, and the appropriate amounts of binders. The briquettes of run 15 were prepared from mixtures containing 6000 parts by weight sand, 3000 parts by weight petrolum coke, 3000 parts by weight coal, 100 parts by weight water, and the appropriate amounts of binders. The briquettes of runs 11, 12 and 13 are presented for comparison purposes only.

TABLE III

| Run No. | Primary Binder | Primary Binder, % | Secondary Binder, % |
|---|---|---|---|
| 11 | None | 0 | 2.4 |
| 12 | Asphalt Emulsion | 3.8 | 0 |
| 13 | Coal Tar Pitch | 3.8 | 0 |
| 14 | Asphalt Emulsion | 3.7 | 1.8 |
| 15 | Coal Tar Pitch | 3.8 | 2.0 |

The strengths of the various briquettes prepared in runs 11–15 were determined. The results for green, dried and fired briquettes are presented in Table IV.

TABLE IV

| | Crush Strength (lbs) | | | Drop Loss (%) | |
|---|---|---|---|---|---|
| Run No. | Green | Dried | Fired | Green | Dried |
| 11 | 32 | 169 | 45 | 0.4 | 2.3 |
| 12 | 35 | 132 | — | — | — |
| 13 | 28 | 29 | 60 | 55 | 54 |
| 14 | 29 | 183 | — | 0.7 | 0.9 |

TABLE IV-continued

| Run No. | Crush Strength (lbs) | | | Drop Loss (%) | |
|---|---|---|---|---|---|
| | Green | Dried | Fired | Green | Dried |
| 15 | 32 | 139 | 159 | 7.5 | 5.5 |

It is also clear from this example that the mixed binder system of this invention yields agglomerates which generally exhibit high strengths over a wide temperature range. It is also clear that the mixed binder system of this invention yields agglomerates which generally exhibit higher strengths as compared to agglomerates prepared with only the primary binder or only the secondary binder and that these higher values are exhibited over a wide temperature range.

Example 3. This example shows the preparation of briquettes using calcium lignosulfonate as the secondary binder with various primary binders. The identity of the primary binder and the amounts of the binders used are given in Table V. The percentages of the binders is based on the dried weight of the briquettes. The briquettes of runs 16, 17 and 18 were prepared from mixtures containing 5000 parts by weight sand, 2500 parts by weight petrolum coke, 2500 parts by weight coal, 150–200 parts by weight water, and the appropriate amounts of binders. The briquettes of runs 19, 20, 21 and 22 were prepared from mixtures containing 6000 parts by weight sand, 3000 parts by weight petrolum coke, 3000 parts by weight coal, 70–150 parts by weight water, and the appropriate amounts of binders. The briquettes in runs 16, 17 and 18 are presented for comparison purposes only. The calcium lignosulfonate used in runs 16, 19 and 21 was Lignosite. The calcium lignosulfonate used in runs 20 and 22 was Orzan LS.

TABLE V

| Run No. | Primary Binder | Primary Binder, % | Secondary Binder, % |
|---|---|---|---|
| 16 | None | 0 | 5.3 |
| 17 | Coal Tar Pitch | 3.8 | 0 |
| 18 | Petrolum Pitch | 8.3 | 0 |
| 19 | Petrolum Pitch | 3.7 | 4.6 |
| 20 | Petrolum Pitch | 3.7 | 4.6 |
| 21 | Petrolum Pitch | 3.7 | 4.6 |
| 22 | Coal Tar Pitch | 3.7 | 4.6 |

The strengths of the various briquettes prepared in runs 16–22 were determined. The results for green, dried and fired briquettes are presented in Table VI.

TABLE VI

| Run No. | Crush Strength (lbs) | | | Drop Loss (%) | |
|---|---|---|---|---|---|
| | Green | Dried | Fired | Green | Dried |
| 16 | 18 | 69 | 104 | 0.5 | 6.6 |
| 17 | 28 | 29 | 54 | 55 | 54 |
| 18 | 22 | 29 | 45 | 68 | 68 |
| 19 | 52 | 175 | 170 | 1.6 | 2.0 |
| 20 | 47 | 103 | 105 | 2.0 | 3.8 |
| 21 | 40 | 123 | 78 | 1.2 | 3.4 |
| 22 | 40 | 127 | 114 | 8.3 | 7.9 |

It is clear from this example that the mixed binder system of this invention yields agglomerates which generally exhibit high strengths over a wide temperature range. It is also clear that the mixed binder system of this invention yields agglomerates which generally exhibit higher strengths as compared to agglomerates prepared with only the primary binder or only the secondary binder and that these higher values are exhibited over a wide temperature range.

Example 4. This example demonstrates the preparation of agglomerates using sodium lignosulfonate as the secondary binder with various primary binders. The identity of the primary binder and the amounts of the binders used are given in Table VII. The percentages of the binders is based on the dried weight of the briquettes. The briquettes of runs 23 and 24 were prepared from mixtures containing 5000 parts by weight sand, 2500 parts by weight petrolum coke, 2500 parts by weight coal, about 150 parts by weight water, and the appropriate amounts of binders. The briquettes of runs 25 and 26 were prepared from mixtures containing 6000 parts by weight sand, 3000 parts by weight petrolum coke, 3000 parts by weight coal, 70–120 parts by weight water, and the appropriate amounts of binders. The sodium lignosulfonate used in run 23 was Lignosite 458 and in runs 25 and 26 it was Orzan S. Runs 23 and 24 are presented for comparison purposes only.

TABLE VII

| Run No. | Primary Binder | Primary Binder, % | Secondary Binder, % |
|---|---|---|---|
| 23 | None | 0 | 5.3 |
| 24 | Coal Tar Pitch | 3.8 | 0 |
| 25 | Coal Tar Pitch | 3.7 | 4.6 |
| 26 | Petrolum Pitch | 3.7 | 4.6 |

The strengths of the various briquettes prepared in runs 23–26 were determined. The results for green, dried and fired briquettes are presented in Table VIII.

TABLE VIII

| Run No. | Crush Strength (lbs) | | | Drop Loss (%) | |
|---|---|---|---|---|---|
| | Green | Dried | Fired | Green | Dried |
| 23 | 7 | 13 | 47 | 48 | 73 |
| 24 | 28 | 29 | 60 | 55 | 54 |
| 25 | 38 | 128 | 95 | 1.7 | 4.8 |
| 26 | 32 | 95 | — | 7.3 | 3.5 |

It is clear from this example that the mixed binder system of this invention yields agglomerates which generally exhibit high strengths over a wide temperature range. It is also clear that the mixed binder system of this invention yields agglomerates which generally exhibit higher strengths as compared to agglomerates prepared with only the primary binder or only the secondary binder and that these higher values are exhibited over a wide temperature range.

Example 5. This example demonstrates the preparation of agglomerates using ammonium lignosulfonate as the secondary binder with various primary binders. The identity of the primary binder and the amounts of the binders used are given in Table IX. The percentages of the binders is based on the dried weight of the briquettes. The briquettes of runs 27 and 28 were prepared from mixtures containing 5000 parts by weight sand, 2500 parts by weight petrolum coke, 2500 parts by weight coal, 150–450 parts by weight water, and the appropriate amounts of binders. The briquettes of runs 29 and 30 were prepared from mixtures containing 6000 parts by weight sand, 3000 parts by weight petrolum coke, 3000 parts by weight coal, 70–90 parts by weight water, and the appropriate amounts of binders. The ammonium lignosulfonate used in run 27 was Norlig NH, in run 29 it was Orzan A, and in run 30 it was Lignosite 17. Runs 27 and 28 are presented for comparison purposes only.

TABLE VII

| Run No. | Primary Binder | Primary Binder, % | Secondary Binder, % |
|---|---|---|---|
| 27 | None | 0 | 4.3 |
| 28 | Coal Tar Pitch | 3.8 | 0 |
| 29 | Coal Tar Pitch | 3.7 | 4.8 |
| 30 | Petrolum Pitch | 3.7 | 4.6 |

The strengths of the various briquettes prepared in runs 23–26 were determined. The results for green, dried and fired briquettes are presented in Table X.

TABLE X

| | Crush Strength (lbs) | | | Drop Loss (%) | |
|---|---|---|---|---|---|
| Run No. | Green | Dried | Fired | Green | Dried |
| 27 | 8 | 80 | 76 | 53.7 | 6.9 |
| 28 | 28 | 29 | 60 | 55 | 54 |
| 29 | 39 | 120 | 60 | 2.1 | 2.1 |
| 30 | 56 | 141 | — | 1.6 | 2.9 |

It is clear from this example that the mixed binder system of this invention yields agglomerates which generally exhibit high strengths over a wide temperature range. It is also clear that the mixed binder system of this invention yields agglomerates which generally exhibit higher strengths as compared to agglomerates prepared with only the primary binder or only the secondary binder and that these higher values are exhibited over a wide temperature range.

Example 6. This example shows a briquette prepared by the method of this invention which contains both silica and iron oxide as the reductants. The briquettes were prepared from mixtures containing 3000 parts by weight sand, 1660 parts by weight petrolum coke, 1600 parts by weight coal, 2000 parts by weight iron oxide, 422 parts by weight water, 416 parts by weight coal tar pitch as the primary binder, and 500 parts by weight calcium lignosulfonate (Lignosite) as the secondary binder. The briquettes contained 4.5 weight percent of the primary binder and 5.4 percent of the secondary binder on a dried basis. The green briquettes had a crush strength of 40 pounds and a drop loss of 4.4 percent. The dried briquettes had a crush strength of 137 pounds and a drop loss of 3.4 percent. Briquettes fired to 950° C. had a crush strength of 174 pounds.

Example 7. This example shows a briquette prepared by the method of this invention with a residue material obtained from the reaction of silicon with methyl chloride in a fluidized reactor. The residue material contains unreacted silicon, copper, iron, carbon in various chemical forms and other impurities. One sample of briquettes were prepared from mixtures containing 1520 parts by weight petrolum coke, 1520 parts by weight coal, 5000 parts by weight residue material, 675 parts by weight water, 420 parts by weight coal tar pitch as the primary binder, and 504 parts by weight calcium lignosulfonate (Lignosite) as the secondary binder. The briquettes contained 4.7 weight percent of the primary binder and 5.6 percent of the secondary binder on a dried basis. The green briquettes of this sample had a crush strength of 49 pounds and a drop loss of 2.8 percent. The dried briquettes of this sample had a crush strength of 135 pounds and a drop loss of 3.2 percent. Briquettes of this sample fired to 950° C. had a crush strength of greater than 190 pounds.

A second sample of briquettes was prepared from a mixture containing 6000 parts by weight of the residue material, 575 parts by weight water, 300 parts by weight coal tar pitch as the primary binder, and 360 parts by weight calcium lignosulfonate (Lignosite) as the secondary binder. The briquettes contained 4.5 weight percent of the primary binder and 5.4 percent of the secondary binder on a dried basis. The green briquettes of this sample had a crush strength of 57 pounds and a drop loss of 7.2 percent. The dried briquettes of this sample had a crush strength of 138 pounds and a drop loss of 5.3 percent. Briquettes of this sample fired to 950° C. had a crush strength of greater than 190 pounds.

Example 8. This example shows briquettes prepared with the mixed binder system which contain alumina. The briquettes were prepared from a mixture containing 1500 parts by weight petrolum coke, 1500 parts by weight coal, 6000 parts by weight alumina, 875 parts by weight water, 450 parts by weight coal tar pitch as the primary binder, and 480 parts by weight calcium lignosulfonate (Lignosite) as the secondary binder. The briquettes contained 4.5 weight percent of the primary binder and 4.8 percent of the secondary binder on a dried basis. The green briquettes had a crush strength of 54 pounds and a drop loss of 12.1 percent. The dried briquettes had a crush strength of 91 pounds and a drop loss of 9.5 percent. Briquettes fired to 950° C. had a crush strength of 101 pounds.

Example 9. This example demonstrates the preparation of briquettes containing silicon carbide. The briquettes were prepared from a mixture containing 5442 parts by weight sand, 6925 parts by weight petrolum coke, 3485 parts by weight silicon carbide, 450 parts by weight water, 715 parts by weight coal tar pitch as the primary binder, and 853 parts by weight calcium lignosulfonate (Lignosite) as the secondary binder. The briquettes contained 4.1 weight percent of the primary binder and 4.9 percent of the secondary binder on a dried basis. The green briquettes had a crush strength of 28 pounds and a drop loss of 4.7 percent. The dried briquettes had a crush strength of 141 pounds and a drop loss of 0.7 percent.

Example 10. This example shows the preparation of briquettes containing a reducing agent without any added reductants using the mixed binder system. The briquettes were prepared from a mixture containing 10000 parts by weight petrolum coke, 217 parts by weight water, 450 parts by weight coal tar pitch as the primary binder, and 480 parts by weight calcium lignosulfonate (Lignosite) as the secondary binder. The briquettes contained 4.1 weight percent of the primary binder and 4.4 percent of the secondary binder on a dried basis. The green briquettes had a crush strength of 44 pounds and a drop loss of 2.0 percent. The dried briquettes had a crush strength of 91 pounds and a drop loss of 7.0 percent. Briquettes fired to 950° C. had a crush strength of 64 pounds.

That which is claimed is:

1. A method of making agglomerates for use in the production of metals and metal alloys, said method comprising the steps of (A) wet mixing (1) a material or materials capable of being reduced, (2) a carbonaceous reducing agent, and (3) a mixed binder system;

(B) forming the wet mixture of step (A) into agglomerates using pressure, and (C) drying the agglomerates formed in step (B);

wherein said mixed binder system consists essentially of a primary binder and a secondary binder; wherein said primary binder is selected from the group consisting of coal tar pitch, asphalt, and petroleum pitch; wherein said secondary binder is selected from the group consisting of lignosulfonate salts, carbohydrates, and silicates; and wherein the weight ratio of the primary binder to the secondary binder varies from about 20:1 to 1:20 in said mixed binder system.

2. A method as defined in claim 1 wherein said material or materials capable of being reduced are selected from the group consisting of a silica-containing material, an iron oxide-containing material, a nickel oxide-containing material, a chromium oxide-containing material, a fluorite-containing material, and an alumina-containing material.

3. A method as defined in claim 1 wherein said material or materials capable of being reduced are selected from the group consisting of a silica-containing material and iron oxide-containing material.

4. A method as defined in claim 1 wherein said material capable of being reduced is a silica-containing material.

5. A method as defined in claim 1 wherein the weight ratio of the primary binder to the secondary binder varies from about 5:15 to 1:5 in said mixed binder system.

6. A method as defined in claim 2 wherein the weight ratio of the primary binder to the secondary binder varies from about 1:5 to 1:5 in said mixed binder system.

7. A method as defined in claim 3 wherein the weight ratio of the primary binder to the secondary binder varies from about 1:5 to 1:5 in said mixed binder system.

8. A method as defined in claim 4 wherein the weight ratio of the primary binder to the secondary binder varies from about 1:5 to 1:5 in said mixed binder system.

9. A method as defined in claim 5 wherein said secondary binder is a lignosulfonate salt.

10. A method as defined in claim 7 wherein said secondary binder is a lignosulfonate salt.

11. A method as defined in claim 8 wherein said secondary binder is a lignosulfonate salt.

12. A method as defined in claim 9 wherein said secondary binder is selected from the group consisting of calcium lignosulfonate, sodium lignosulfonate and ammonium lignosulfonate and said primary binder is coal tar pitch.

13. A method as defined in claim 10 wherein said secondary binder is selected from the group consisting of calcium lignosulfonate, sodium lignosulfonate and ammonium lignosulfonate and said primary binder is coal tar pitch.

14. A method as defined in claim 11 wherein said secondary binder is selected from the group consisting of calcium lignosulfonate, sodium lignosulfonate and ammonium lignosulfonate and said primary binder is coal tar pitch.

15. A method as defined in claim 12 wherein said secondary binder is calcium lignosulfonate.

16. A method as defined in claim 13 wherein said secondary binder is calcium lignosulfonate.

17. A method as defined in claim 14 wherein said secondary binder is calcium lignosulfonate.

* * * * *